US006390162B1

(12) United States Patent
Sahlem

(10) Patent No.: US 6,390,162 B1
(45) Date of Patent: May 21, 2002

(54) LOG SPLITTER

(76) Inventor: Donald P. Sahlem, 4635 N. Millgrove Rd., Akron, NY (US) 14001

( * ) Notice: Subject to any disclaimer, the term of this patent is extended or adjusted under 35 U.S.C. 154(b) by 0 days.

(21) Appl. No.: 09/849,876

(22) Filed: May 4, 2001

(51) Int. Cl.[7] ..... B24L 7/00

(52) U.S. Cl. ..... 144/195.7; 29/275; 144/195.1; 144/195.8; 144/366; 254/104; 227/10

(58) Field of Search ..... 144/193.1, 195.5, 144/195.1, 195.8, 195.7, 366; 227/8, 10; 29/275; 254/21, 104

(56) References Cited

U.S. PATENT DOCUMENTS

| | | | | |
|---|---|---|---|---|
| 508,221 A | * 11/1893 | Hill | 144/195.1 |
| 513,637 A | 1/1894 | Fox | 144/195.1 X |
| 2,851,072 A | 9/1958 | Gerjets et al. | 144/195.1 |
| 3,967,771 A | 7/1976 | Smith | 227/10 |
| 4,081,008 A | 3/1978 | Dilling | 144/193.1 |
| 4,112,985 A | 9/1978 | Gosselin | 144/195.1 |
| 4,300,287 A | 11/1981 | Tibbs | 30/289 |
| 4,510,748 A | 4/1985 | Adams | 60/39.02 |
| 4,905,746 A | 3/1990 | Bedard | 144/195.4 |
| 4,926,537 A | 5/1990 | Pool | 29/275 |
| 5,090,606 A | 2/1992 | Torii et al. | 227/10 |
| 5,103,544 A | 4/1992 | Patterson et al. | 29/275 |
| 5,107,911 A | 4/1992 | Plakotaris | 144/193.1 |
| 5,497,555 A | 3/1996 | Averbukh | 30/362 |
| 5,547,001 A | 8/1996 | Cumming et al. | 144/195.4 |
| 6,201,362 B1 | 3/2001 | DeMichelis | 318/126 |

* cited by examiner

*Primary Examiner*—W Donald Bray
(74) *Attorney, Agent, or Firm*—Simpson & Simpson, PLLC

(57) ABSTRACT

A log splitter is disclosed as employing a fluid driven hammer adapted to impart successive log splitting movements to a log splitting element, a manually operable parallelogram linkage for supporting the hammer for vertical movement relative to an upper position for removably positioning the splitting element in engagement with a log to be split, and a control for controlling operation of the hammer.

16 Claims, 3 Drawing Sheets

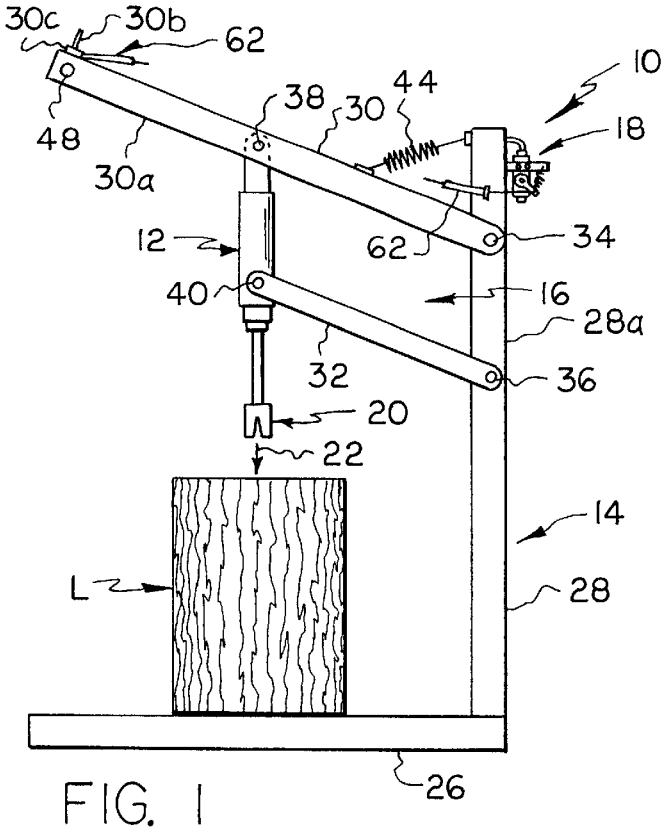
FIG. 1
FIG. 2
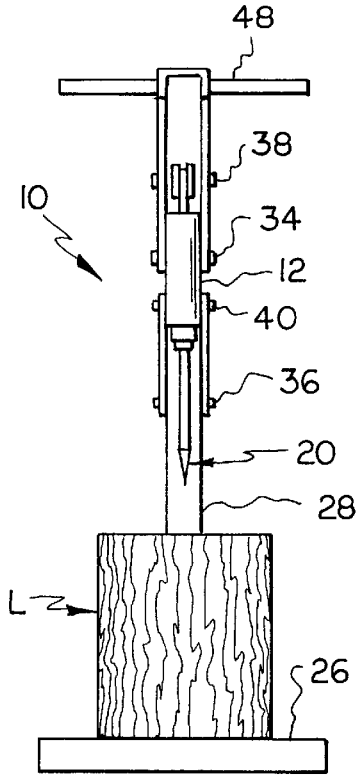
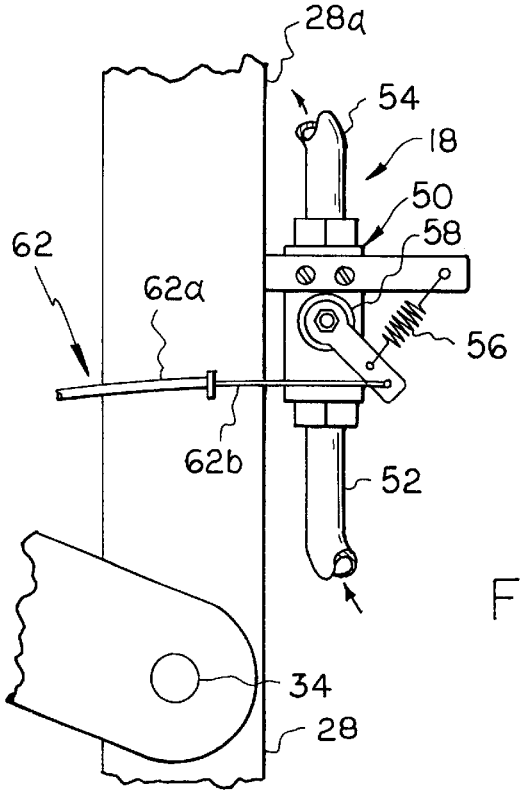
FIG. 3

LOG SPLITTER

FIELD OF THE INVENTION

The present invention relates to log splitters, and more particularly to a log splitter employing a fluid-powered hammer of known construction to split a log without requiring a user to manually manipulate and guide the hammer during use.

BACKGROUND OF THE INVENTION

Heretofore, it has been proposed in U.S. Pat. Nos. 4,669,552 and 5,107,911 to employ manually manipulate jack hammers to split logs. In each case, a user is required to lift the hammer, place the hammer in vertical alignment with a log to be split and thereafter manually support the hammer as it operates upon the log. Jack hammers used in this manner can place a substantial strain on the back of a user and can possibly result in injury to the user in the event the log to be split should tilt or slide from beneath the splitting point or wedge of the hammer at the outset of the splitting operation.

It has also been known to support a steam driven hammer on a framework for purposes of applying blows to an article supported on an anvil disposed below and in vertical alignment with the hammer. This construction is quite complicated and believed not to be readily adapted for use in the splitting of logs.

SUMMARY OF THE INVENTION

The present invention is directed to a relatively low cost and easily operated log splitter particularly adapted for use by home owner or small wood lot owner who wishes to split wood for home fireplace consumption.

BRIEF DESCRIPTION OF THE DRAWINGS

The nature and mode of operation of the present invention will now be more fully described in the following detailed description taken with the accompanying drawings wherein:

FIG. 1 is a side elevational view of a log splitter formed in accordance with the present invention;

FIG. 2 is a side elevational view, as viewed from the left of FIG. 1;

FIG. 3 is an enlarged, partial side elevational view of the log splitter, as viewed from the right of FIG. 1;

DETAILED DESCRIPTION OF THE PREFERRED EMBODIMENT

Figures 4, 5, 6, 7, 8, 9, 10, 11, 12:
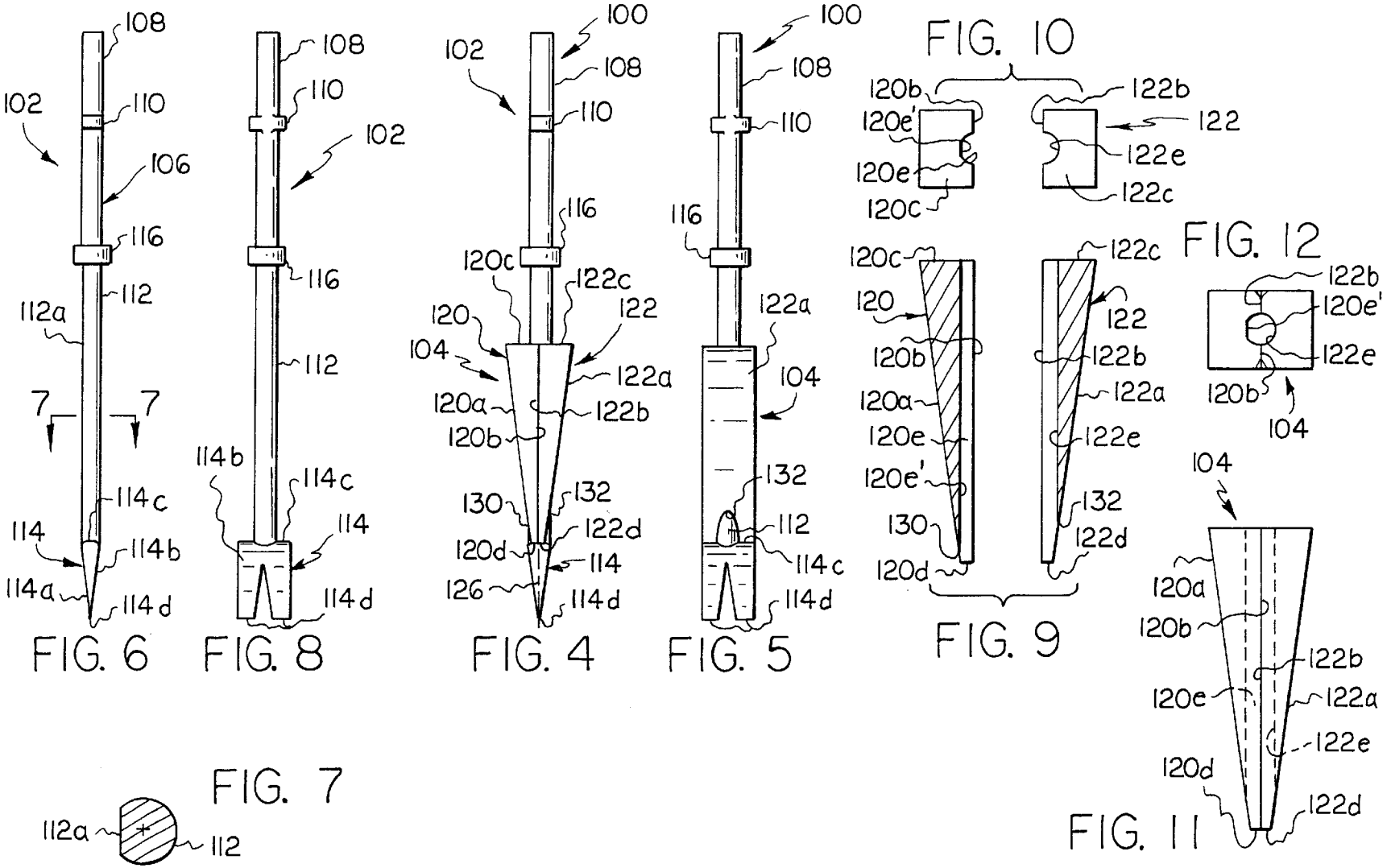
FIG. 4 is a side elevational view of a two-stage splitting wedge assembly formed in accordance with an alternative form of the present invention.
FIG. 5 is a side elevational view thereof, as viewed from the right of FIG. 4.
FIG. 6 is a side elevational view of a chisel portion of the wedge assembly of FIG. 4.
FIG. 7 is a sectional view taken generally along the line 7—7 in FIG. 6.
FIG. 8 is a side elevational view of the chisel portion of the wedge assembly, as viewed from the right of FIG. 6.
FIG. 9 is an exploded vertical sectional view of a wedge portion of the wedge assembly of FIG. 4.
FIG. 10 is an exploded top plan view of the wedge portion.
FIG. 11 is a side elevational view of the wedge position in assembled condition.
FIG. 12 is a top plan view of the wedge portion of FIG. 10.

A log splitting device according to a preferred form of the present invention is generally designated as 10, and shown as including a fluid powered impact hammer 12 supported for vertically directed movement relative to a base 14 by a linkage 16, and a control 18 for controlling operation of the hammer. A log to be split is designated by the letter "L".

Hammer 12 is preferably a conventional pressurized air powered hammer having a log splitting element in the form of a wedge 20 to which it is adapted to impart an impact force during each operational cycle of the hammer, as indicated by arrow 22 in FIG. 1. A hammer of this type may be supplied with air under pressure from a suitable air compressor, not shown. It is contemplated that in accordance with a preferred form of the invention, the trigger, not shown, of hammer 12 may be fixed in an on position, such that the hammer will operate through successive cycles, as long as pressurized air is supplied to the hammer, and that the flow of pressurized air to the hammer would be under the control of control 18, which is best shown in FIG. 3. It is, however, contemplated that other fluids, such as steam supplied by a suitable steam generator may be employed to operate hammer 12. Moreover, it is contemplated that hammer 12 may be an electromagnetic hammer or a hammer powered by gases generated by burning of a combustible mixture within a cylinder forming an integral part of the hammer. In this latter case, control 18 could be arranged to permit its operation of a trigger mechanism of the hammer.

Base 14 preferably includes a ground or otherwise supported support plate 26 and a post 28 arranged to vertically upstand from the support plate. Alternatively, post 28 may be otherwise supported, such as being fixed to any suitable vertically extending, rigid object, such as a wall, and in this case a log "L" to be split would be simply arranged to upstand from the ground.

Linkage 16 is preferably in the form of a parallelogram linkage having a pair of opposite vertically extending links, defined by hammer 12 and an upper end portion **28*a* of post 28, a pair of vertically spaced links defined by an elongated upper link 30 and a lower link 32. Post end portion 28*a* is pivotally coupled to first ends of upper link 30 and lower link 32 by a first pair of upper and lower pivot pins 34 and 36, respectively, and hammer 12 is pivotally coupled to a mid-portion of upper link and a second end of lower link 32 by a second pair of upper and lower pivot pins 38 and 40, respectively. Pivot pins 34, 36, 38 and 40 have parallel pivot axes, and the transverse spacing between pivot pins 34 and 36 is preferably equal to the transverse spacing between pivot pins 38 and 40, and the transverse spacing between pivot pins 38 and 34 is preferably equal to the transverse spacing between pivot pins 40 and 36. Alternatively, a separate vertically extending link, not shown, may be pivotally connected to links 30 and 32 by pivot pins 38 and 40, and hammer 12** suitably fixed to such separate link.

By use of a parallelogram linkage, hammer 12 is constrained to be maintained in constant vertical orientation, e.g. parallel to post 28, during vertical movements of the hammer downwardly from and during return to an inoperative or upper position shown in FIGS. 1 and 2. The inoperative upper position of hammer 12 may be variously defined, such as by providing post 28 with an abutment, not shown, arranged for engagement by upper link 30, and a spring 44 shown only in FIG. 1, employed to normally bias the hammer to normally assume its inoperative position.

Preferably, the free swinging end 30*a* of upper link 30 is provided with a transversely extending handle 48, which can be gripped by the hand of an operator whenever he wishes to initiate movement of hammer 12 downwardly away from its inoperative position.

Control 18 is best shown in FIG. 3 as including an air flow control valve 50 having an inlet conduit 52 connected to a source of air under pressure, not shown, and a discharge conduit 54 connected to hammer 12. Valve 50 is normally maintained in closed or flow blocking condition by a return spring 56 acting on rotary valve part 58, but may be moved into an open position, not shown, to place conduits 52 and 54 in flow communication for purposes of operating the hammer by operation of a control cable 62. Cable 62 includes a sheaf 62*a* and a movable control wire 62*b,* which is slidably received within the sheaf and has its opposite ends connected to a rotatable valve part 58 and an operating lever 30*b,* which is pivotally supported by a bracket 30*c* in turn mounted on the free swinging end 30*a* of upper link 30 or on handle 48, as desired. By pivoting lever 30*b* in a counterclockwise direction, as viewed in FIG. 1, valve part 58 is caused to rotate in a clockwise direction, as viewed in FIG. 3, to open valve 50 against the bias of spring 56. If desired, lever 30*b* and bracket 30*c* may be similar in construction to a typical bicycle handle mounted brake operator. Also, it is contemplated that valve 50 may be dispensed with and lever 30*b* connected to the trigger of hammer 12 by control cable 12 or other suitable control linkage, such that a trigger operated flow control valve arranged internally of the hammer is used in place of valve 50.

In operation of the preferred form of log splitter 10, a log "L" is first placed on support plate 26 to upstand in vertical alignment with splitting element 20, while hammer is maintained in its illustrated upper inoperative position by spring 44. In this position of hammer 12, return spring 56 is operative to maintain valve 50 in its closed condition, wherein flow of air from inlet conduit 52 to discharge conduit 54 is blocked, thereby resulting in the hammer being rendered inoperative for lack of pressurized air supplied thereto.

Thereafter, when an operator wishes to split log "L", he grasps handle 48 and pulls downwardly to place splitting element 20 in engagement with the log. At some desired position of hammer 12, the operator pivots lever 30*b* in order to cause sliding movement of control wire 62*b* within sheaf 62*a* with the result that valve part 58 is caused to rotate sufficiently to move valve 50 into an open position, thereby placing conduits 52 and 54 in flow communication. Thus, pressurized air is supplied to hammer 12 during an operator determined portion of the downward movement of the hammer away from its illustrated inoperative position for purposes of imparting successive blows to wedge 20, as required to effect splitting of the log, and operation of the hammer continues until the lever 30*b* is released in order to permit spring 56 to return valve 50 to its original closed condition. Spring 44 in turn returns hammer 12 to its operative position upon release of handle 48.

A modified form of the present invention is shown in FIGS. 4–15, wherein 100 designates a two-stage splitting wedge assembly adapted for use in splitting a log "L". Assembly 100 includes a chisel portion 102 and a wedge portion 104 slidably mounted on the chisel portion for movement between a first position shown in FIGS. 4, 5 and 13, and a second position shown in FIGS. 14 and 15.

Chisel portion 102 is best shown in FIGS. 6–8 as including an elongated shank 106 having a cylindrical mounting end portion 108 provided with an oval-shaped shoulder 110, and a generally cylindrical opposite end portion 112 mounting a fork-shaped chisel 114 having a pair of chisel side surfaces 114*a* and 114*b,* which converge downwardly from a chiseled upper edge 114*c* to define a knife edge 114*d.* Opposite end portion 112 is separated from the mounting end portion by a round shoulder or abutment 116. As best shown in FIGS. 6 and 7, opposite end portion 112 is provided with a flat surface 112*a* extending downwardly between shoulder 116 and chisel 114. It will be understood that end portion 108 and oval-shaped shoulder 110 may be employed to removably mount assembly 100 on hammer 12, as is known in the art relating to fluid-powered hammers.

Wedge portion 104 is best shown in FIGS. 9–12 as being of a two-part construction consisting of first and second wedge halves 120 and 122 formed with planar, oppositely-facing and downwardly convergent wedge surfaces 120*a* and 122*a;* planar, facing surfaces 120*b* and 122*b;* coplanar upper end abutment surfaces 120*c* and 122*c;* and coplanar lower end abutment surfaces 120*d* and 122*d.* Facing guide recesses 120*e* and 122*e* are arranged to open through facing surfaces 120*b* and 122*b,* respectively, and are shaped and sized to slidably engage with opposite end portion 112 for purposes of mounting wedge portion 104 for sliding movements between its first and second positions. It will be noted by viewing FIGS. 10 and 12 that recess 120*e* is formed with a lengthwise extending flat surface 120*e',* which is arranged to slidably engage with flat surface 112*a* in order to constrain wedge portion 104 from rotation about the axis of shank end portion 112 away from its position or orientation shown in FIG. 4, wherein facing surfaces 120*b* and 122*b* are disposed parallel to a bisection plane 126 extending vertically through the chisel cutting edge 114*d.* It will also be noted that guide recesses 120*e* and 122*e* are of sufficient depth, such that they cooperate with wedge surfaces 120*a* and 122*a* to define wedge surface cut outs 130 and 132, which extend upwardly from lower abutment surfaces 120*d* and 122*d,* as best shown in FIGS. 4, 5 and 9. Preferably, the widths of wedge halves 120 and 122 correspond to the width of chisel 114, as shown in FIG. 5, and the sum of the thicknesses of lower end abutment surfaces 120*d* and 122*d* is less than the maximum thickness of the upper edge 114*c* of chisel 114, as shown in FIG. 4.

After forming wedge halves 120 and 122 as separate parts, as shown in FIGS. 9 and 10, the halves are placed about end portion 112 and thereafter joined, as in welding, to form an unitary structure arranged to surround shank end portion 112 intermediate chisel 114 and shoulder 116.

Figure 13:
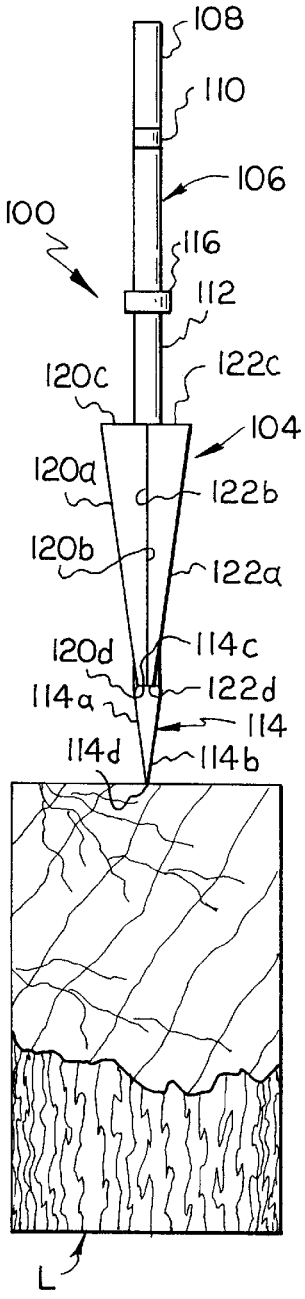
FIG. 13 is a side elevational view of the wedge assembly arranged in contact with a log to be split.
Figure 14:
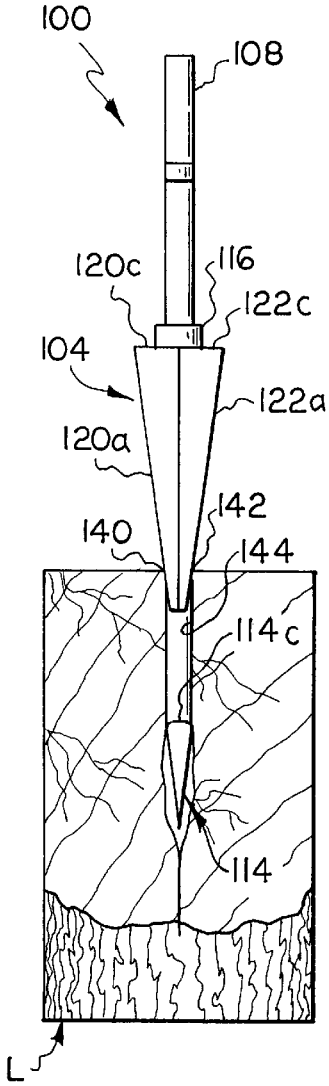
FIG. 14 is a view similar to FIG. 13, but showing the wedge assembly upon completion of initial penetration of a log by the chisel portion of the assembly.

In use of a log splitter fitted with assembly 100, the assembly is first mounted on hammer 12 and a log "L" then placed on support plate 26 to upstand in vertical alignment with chisel 114, while the hammer is maintained in its upper inoperative position. Thereafter, an operator grasps handle 48 and pulls downwardly thereon to place chisel 114 in engagement with the previously positioned log "L", as shown in FIG. 13. Upon placement of chisel 114 in engagement with log "L", or if desired, as an incident to downward movement of hammer 12, lever 30*b* is operated to open valve 50 and supply pressurized air or other fluid to the hammer. Up to this point, wedge portion 104 rests in its lower or first position under the influence of gravity, wherein lower abutment surfaces 120*d* and 122*d* rest on or abut against the chisel upper edge surface 114*c,* as shown in FIG. 13. Operation of hammer 12 with chisel 114 engaged with log "L" serves to drive the chisel downwardly into the log to first place those portions of wedge surfaces 120*a* and 122*a,* which are disposed adjacent the upper ends of wedge surface cutouts 130 and 132, in engagement with adjacent edges 140 and 142 of the log "L", which bound the split or opening 144 created in the log by chisel 114. Thereafter, wedge portion 104 is forced to slide upwardly relative shank lower portion 112 until upper abutment surfaces 120*c* and 122*c* move into engagement with enlargement 116 to complete a first stage of a log splitting operation as shown in FIG. 14.

Figure 15:
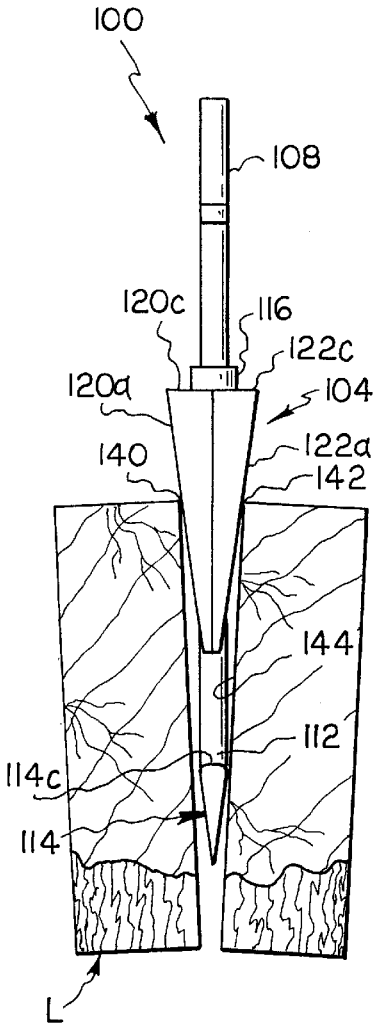
FIG. 15 is a view similar to FIGS. 13 and 14, but showing the wedge assembly during a further penetration of a log by the wedge portion of the assembly.

Upon continued operation of hammer 12, wedge portion 104 is forced by enlargement 116 to move further downwardly into split 144, whereupon wedge surfaces 120*a* and 122*a* serve to progressively enlarge or increase the width of the split until a second stage of the log splitting operation is completed with the final separation of the log into lengthwise extending pieces, as shown in FIG. 15.

Various further modifications in the construction of the present log splitter are contemplated without departing from the present invention. In this respect, the length of post 28 may be made adjustable, as desired to compensate for varying lengths of logs to be split, and the upper and lower links of linkage 16 may be reversed, if desired to increase the stability of the log splitter. Further, in that wedge 20 follows an arculate path when hammer 12 is supported by a parallelogram, it may be desirable, particularly when splitting longer logs, to mount support plate 26 for horizontal sliding movement in order to reduce any tendency of a log to tilt, as the wedge moves downwardly through a log. Alternately, wedge may be mounted to permit horizontal sliding displacements thereof in order to prevent tilting of a log during splitting thereof. Still further, operation of hammer 12 may be automatically controlled as an incident to vertical movement of hammer 12. In this respect, lever 30*b* and bracket 30*c* may be dispensed with and an end of control wire 62*b* connected directly to the free swinging end of the upper link 30, such that valve 50 is forced to open incident to movement of hammer 12 downwardly away from its inoperative position and permitted to close under the influence of spring 56, as the hammer is returned to its inoperative position by spring 44.

What I claim is:

1. A log splitter comprising:

a fluid powered impact hammer having a log splitting element and being operable for imparting log splitting impact force to said element;

a control for controlling operation of said hammer;

a base;

a linkage for supporting said hammer on said base for vertical movement relative to a log to be split; and a means for imparting said vertical movement to said hammer for removably placing said element in engagement with a log to be split.

2. A log splitter according to claim 1, wherein said base includes a vertically disposed post, said linkage is a parallelogram linkage comprising a pair of opposite vertically extending links defined by said hammer and said post and a pair of vertically spaced links defined by an upper link pivotally connected to said post and an upper end portion of said hammer and a lower link pivotally connected to said post and a lower end portion of said hammer, and said upper link having a free end portion projecting away from said post beyond said pivotal connection to said hammer for defining said means for imparting said vertical movement in the form of a handle portion engageable.

3. A log splitter according to claim 2, wherein spring means are provided to normally bias said handle portion upwardly towards an upper hammer inoperative position, and said hammer is moved vertically downwardly against said bias by a user engaging said handle portion.

4. A log splitter according to claim 3, wherein said control includes an operator actuated means mounted for movement with said free end portion.

5. A log splitter according to claim 4, wherein said control is a valve controlling flow of fluid to said hammer for effecting operation thereof and a valve control operating cable having a first end operably connected to said valve and a second end connected to said operator actuated means.

6. A log splitter according to claim 5, wherein said base additionally includes a horizontally disposed support plate for supporting a log to be split, and said post upstands from said support plate.

7. A log splitter according to claim 1, wherein spring means is provided to bias said linkage to normally maintain said hammer in an upper inoperative position, said hammer is a pressurized fluid operated hammer, said control includes a pressurized fluid control valve located remotely of said hammer and having a closed position for preventing flow of pressurized fluid to said hammer and an open position permitting flow of pressurized fluid to said hammer for imparting log splitting impact to said element, a return spring tending to bias said control valve into said closed position and a manual operator located remotely of said control valve and operably connected to said control valve by a flexible cable for moving said control valve into open position against said bias of said return spring.

8. A log splitter according to claim 7, wherein said linkage is manually movable to move said hammer from said inoperative position against said bias of said spring means, and said linkage is a parallelogram linkage.

9. A log splitter according to claim 8, wherein said base includes a vertically disposed post, said hammer and control valve are supported on said post, and said manual operator is supported by said linkage.

10. A log splitter according to claim 9, wherein said base includes a horizontally disposed support plate for supporting a log to be split, and said post upstands from said support plate.

11. A log splitter according to claim 1, wherein said element includes a chisel portion operably coupled to said hammer and a wedge portion carried by said chisel portion, said chisel portion mounting a chisel adjacent a free end thereof, said wedge portion having wedge surfaces converging in a direction towards said chisel, characterized in that upon operation of said hammer said chisel is brought into initial engagement with a log to be split to initiate splitting of said log and said wedge surfaces are subsequently brought into engagement with said log to complete splitting of said log.

12. A log splitter according to claim 11, wherein said chisel portion has an abutment spaced from said chisel, and said wedge portion is slidably supported on said chisel portion and has oppositely facing end surfaces adapted to alternatively engage with said chisel and said abutment to limit the extent of sliding movement of said wedge portion relative to chisel portion.

13. A log splitter according to claim 12, wherein said chisel has convergent log splitting surfaces and a maximum thickness, as measured between said splitting surfaces, which is less than the maximum thickness of said wedge portion, as measured between said wedge surfaces.

14. A log splitter comprising:

a fluid powered impact hammer having a wedge-shaped log splitting element to which said hammer imparts impact forces during operation;

a means for supporting said hammer for vertical movement downwardly from an upper inoperative position for placing said log splitting element in engagement with a log to be split and upwardly for return to said inoperative position;

a second means tending to normally maintain said hammer in said upper inoperative position, said means for supporting said hammer being operable by a user to move said log splitting element into engagement with said log to be split incident to downward movement of said hammer from said upper inoperative position;

a third means operable by said user to initiate operation of said hammer; and a fourth means tending to terminate operation of said hammer.

15. A log splitter of claim 14, wherein said second and fourth means are spring means.

16. A log splitter of claim 14, wherein said means for supporting said hammer includes a first vertically upstanding link, an upper link, a lower link and said hammer, first and second pivot means for coupling said vertically extending link to said upper and lower links, and third and fourth pivot means for coupling said hammer to said upper and lower links, said first and second pivot means having a spacing corresponding to that of said third and fourth links, and said first and third pivot means having a spacing corresponding to that of said second and fourth pivot means to define a parallelogram linkage for supporting said hammer for vertical movement.

* * * * *